US006846236B2

(12) United States Patent
Gregoricka

(10) Patent No.: US 6,846,236 B2
(45) Date of Patent: Jan. 25, 2005

(54) PIVOTED FUME HOOD

(75) Inventor: Larry M. Gregoricka, Owosso, MI (US)

(73) Assignee: Viron International Corporation, Owosso, MI (US)

( * ) Notice: Subject to any disclaimer, the term of this patent is extended or adjusted under 35 U.S.C. 154(b) by 0 days.

(21) Appl. No.: 10/341,241

(22) Filed: Jan. 13, 2003

(65) Prior Publication Data

US 2004/0137835 A1 Jul. 15, 2004

(51) Int. Cl.[7] ..... B08B 15/02
(52) U.S. Cl. ..... 454/65; 454/67
(58) Field of Search ..... 454/49, 63, 65, 454/67

(56) References Cited

U.S. PATENT DOCUMENTS 879,463 A * 2/1908 Hansen ..... 126/301
996,554 A * 6/1911 Baldwin et al. ..... 126/345
2,743,100 A * 4/1956 Stephan ..... 266/158
3,481,265 A * 12/1969 Scheel ..... 454/65
3,838,732 A * 10/1974 Overmyer ..... 164/404
3,980,008 A * 9/1976 Martin et al. ..... 454/65
5,951,725 A * 9/1999 Vross et al. ..... 55/356

* cited by examiner

*Primary Examiner*—Harold Joyce
(74) *Attorney, Agent, or Firm*—Price, Heneveld, Cooper, DeWitt & Litton, LLP

(57) ABSTRACT

A fume hood is pivotally mounted on a vertically extending axle fixed to a chemical tank and extending through a sleeve in the hood allowing the fume hood, with a flexible coupling to an exhaust blower, to pivot from a use position adjacent the tank to a position pivoted away from the tank to allow an operator to gain access to the tank. In one embodiment, the hood includes a support leg for supporting the end of the hood remote from the pivot connection to the tank.

22 Claims, 5 Drawing Sheets

PIVOTED FUME HOOD

BACKGROUND OF THE INVENTION

The present invention relates to fume hoods and particularly to fume hoods which are pivoted to gain access to areas located below and/or adjacent the hoods.

In the plating industry, relatively elongated plating tanks are employed and contain electroplating chemical solutions for electroplating parts, such as, for example, chrome plating automotive components. The plating lines require maintenance for cleaning on a periodic basis as well as for replenishing anodes, such as zinc, inserted into anode baskets for providing the plating material source. Further, plating racks, which contain parts to be plated, are dipped and rotated in the plating tanks and can, on occasion, fall into the tanks. Thus, access to the tanks is required for routine maintenance, filling anode baskets, and occasional repair.

In the past, access to the plating tank is restricted by the fixed positioning of fume hoods extending in closely spaced relationship above the tanks. It has been necessary to either attempt to negotiate around fixed fume hoods, which is somewhat difficult and dangerous, or remove one or more fixed fume hoods in order to gain access to the underlying plating tank.

The system of the present invention overcomes these difficulties with existent plating lines.

SUMMARY OF THE INVENTION

The system of the present invention provides a unique pivoted fume hood and, in some embodiments, pairs of fume hoods which are mounted on a vertically extending axle fixed to the plating tank and extending through a sleeve in the hood allowing the fume hood, with a flexible coupling to a blower system, to pivot away from a use position adjacent the plating tank to a position pivoted away from the tank to allow an operator to gain access to a plating tank through the passageway provided by the pivoted fume hood.

In one embodiment of the present invention, the fume hood includes a downwardly depending support leg for supporting the end of the fume hood remote from the pivot connection to the tank. In one embodiment of the invention, a pair of such fume hoods are aligned and pivotally mounted so they pivot away from each other, such that a relatively wide passageway for gaining access to the plating tank is provided. An installation typically will include multiple pairs of such hoods.

With such a system, therefore, an operator can easily manually pivot a fume hood from an aligned use position to a remote position, allowing access to a plating or other chemical tank without requiring disassembly or disconnection of the flume hood from the tank or a venting blower.

These and other features, objects and advantages of the present invention will become apparent upon reading the following description thereof together with reference to the accompanying drawings.

DETAILED DESCRIPTION OF THE PREFERRED EMBODIMENT

Referring initially to FIGS. 1–5, there is shown a manufacturing facility 10 which includes an elongated chemical tank, such as a plating tank, 12 into which is selectively placed a plurality of rotatable plating containers 14, which are conventionally mounted to contain parts to be plated. The containers are rotated while submerged into a plating bath by a pivoted worm and ring gear structure 15 in a conventional manner. Containers 14, once filled with parts to be plated, are pivoted from the position shown in FIGS. 1 and 2 into tank 12 and rotated during the plating process. A plurality of anode baskets (not shown) containing zinc anodes are positioned in tank 12 in a conventional manner and cooperate with the chemical bath contained in the plating medium and applied electrical current for electroplating parts contained in containers 14.

Figure 1:
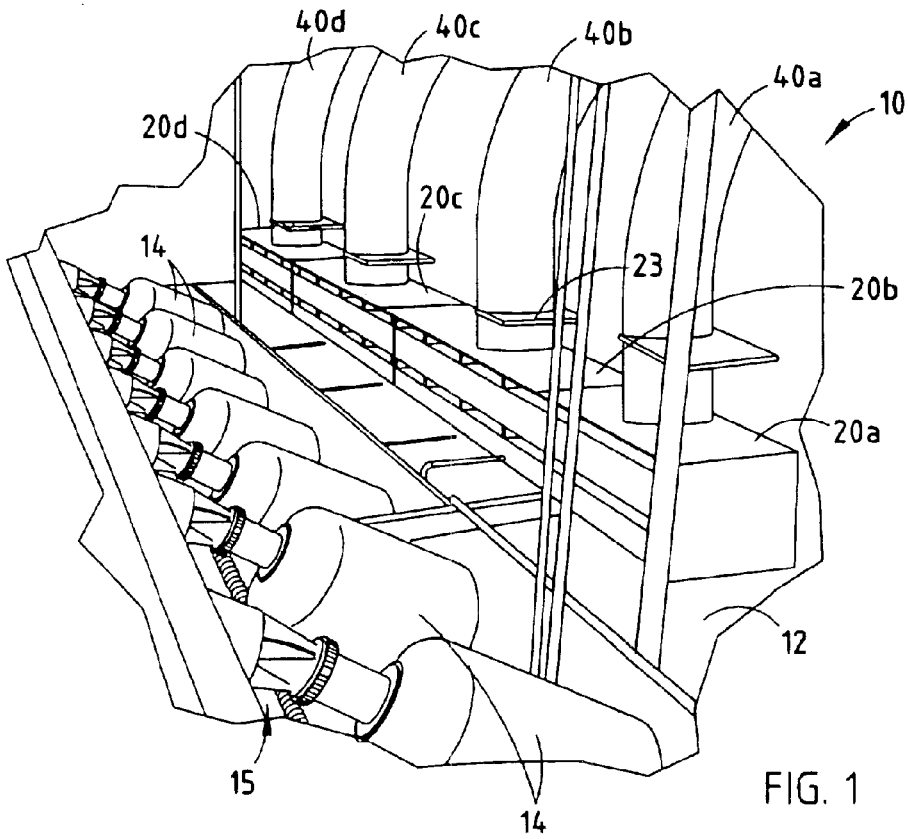
FIG. 1 is a perspective view of a plating facility incorporating the pivoted vent hood system of the present invention, shown with the hoods in an operating position.
Figure 2:
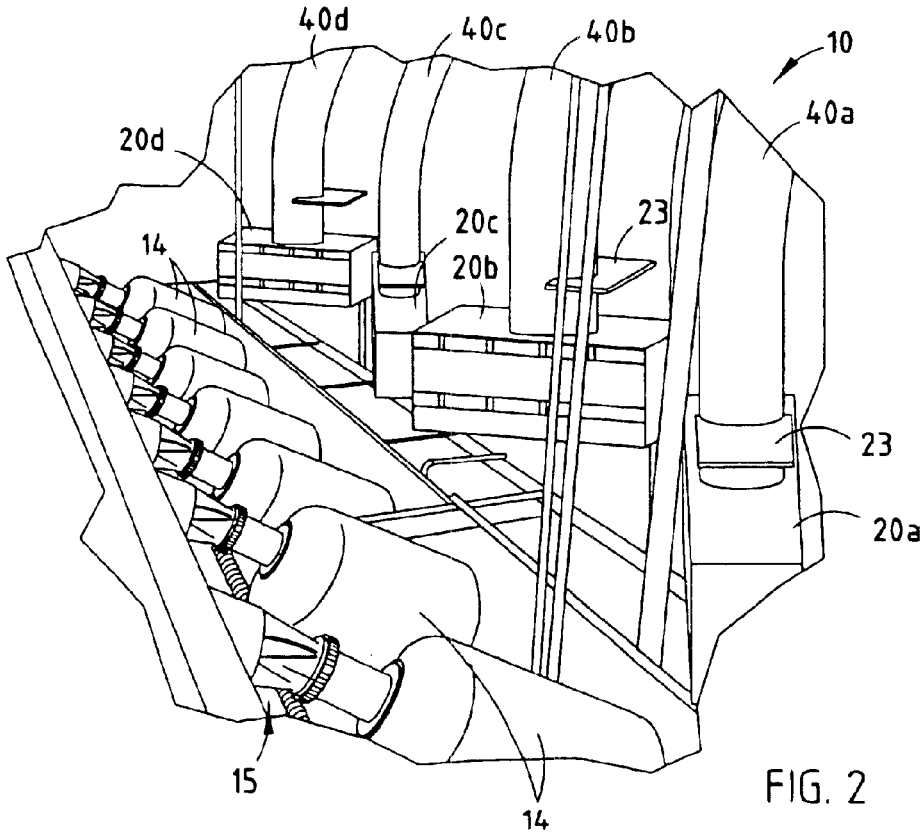
FIG. 2 is a perspective view of the installation shown in FIG. 1, showing the hoods pivoted to a position permitting access to the plating tank.
Figure 3:
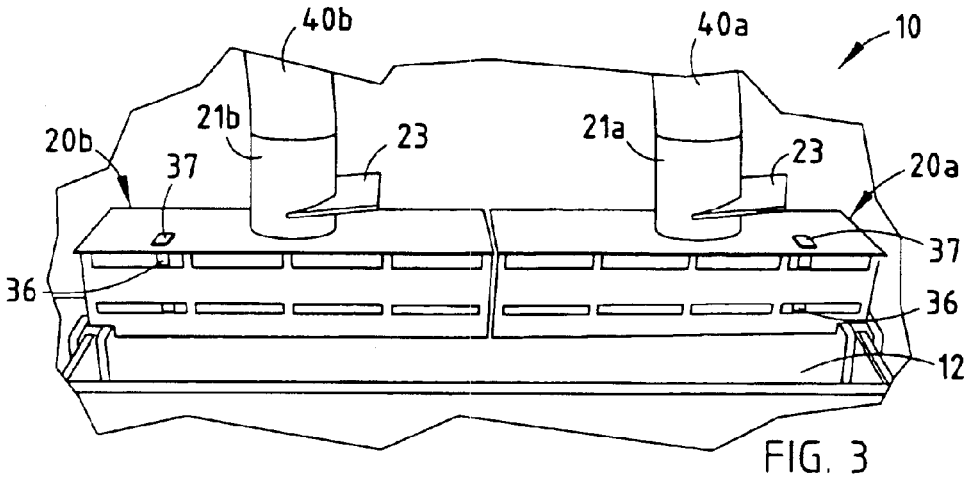
FIG. 3 is a front perspective view of a pair of the hoods shown in FIGS. 1 and 2, shown in their operative position.

In FIG. 1, there is shown a plurality of pivoted vent hoods 20*a*–20*d* embodying the present invention. It is to be understood that a facility will typically include several pairs of such hoods, and the four are shown for illustrative purposes only. Each hood 20*a*–20*d* includes an exhaust outlet collar 21*a*–21*d* (FIGS. 3–5), respectively, which are coupled by flexible ducts 40*a*–40*d*, respectively, that extend from outlet collars 21*a*–21*d* to a common duct leading to the inlet of a fume scrubber for removing toxic, corrosive, or other undesirable materials from the exhaust gases drawn from above plating tank 12. For such purposes, flexible ducts 40*a*–40*d* have length sufficient to allow fume hoods 20*a*–20*d* to be moved without disconnecting from the outlet collars 21*a*–21*d* or the duct to which the other end of flexible ducts 40*a*–40*d* are coupled. The fume hoods 20*a*–20*d* are pivotally mounted to an edge of tank 12 and can be manually pivoted by an operator, as seen in FIGS. 3–5 showing the operation of the pivoted hoods between an aligned position with their longitudinal axis substantially aligned with the longitudinal axis of the plating tank 12 to a position partially pivoted outwardly and away from edge 11 of tank 12, as seen by arrows A in FIG. 4, to a fully open position, as illustrated in FIG. 5, whereupon an operator can gain access over the edge 11 of tank 12 through an open passageway 16 safely and without interference from the fume hoods 20*a*–20*d*.

Figure 4:
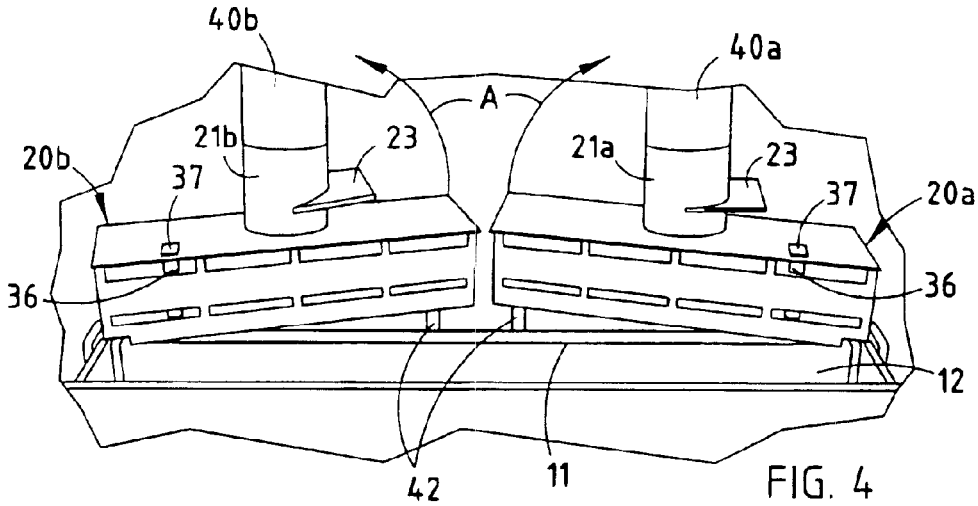
FIG. 4 is a front perspective view of the hoods shown in FIG. 3, showing the hoods being pivoted from an aligned operative position toward an open position.
Figure 5:
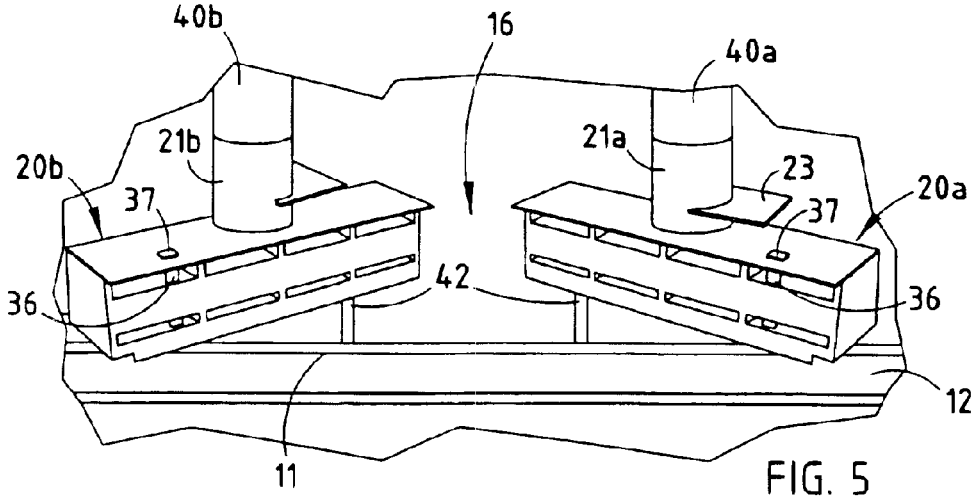
FIG. 5 is a front perspective view of the hoods shown in FIGS. 3 and 4 moved to an open position providing access to the plating tank.

Details of the construction of one of the hoods, such as hood 20*a*, is shown in FIGS. 6–11 and now described, it being understood that the remaining hoods are of substantially identical construction, with the pivot connection of alternate hoods reversed, such that the hoods swing open in opposite directions, as illustrated in FIGS. 4 and 5.

Figure 6:
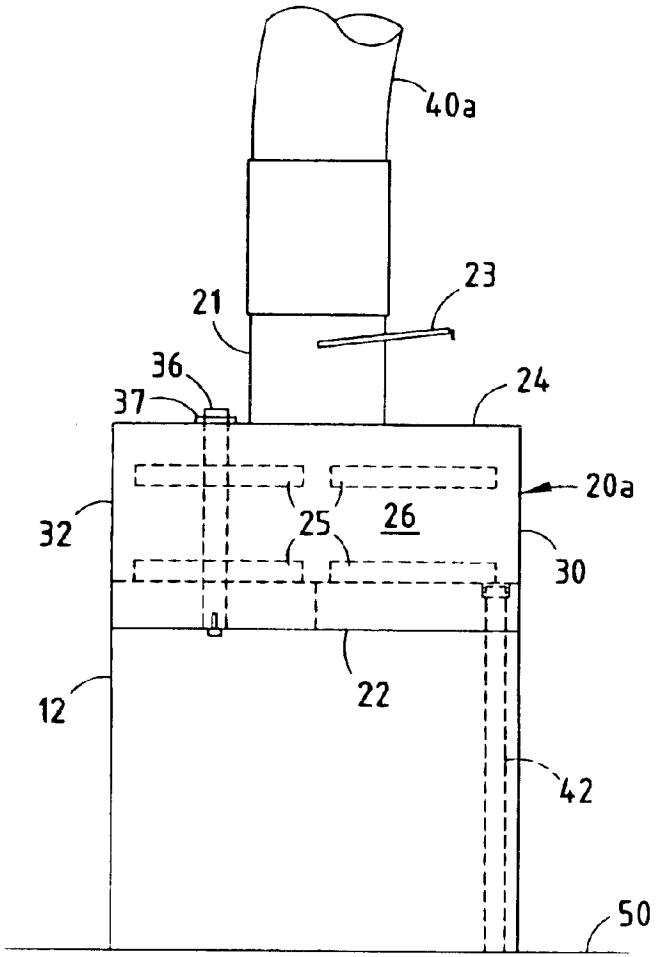
FIG. 6 is a front elevational view of one of the hoods of the present invention.
Figure 9:
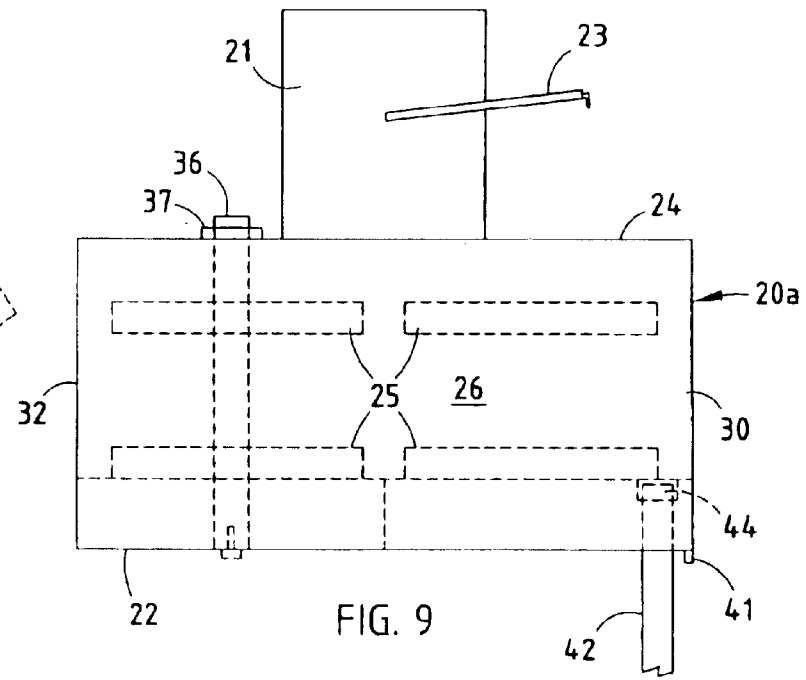
FIG. 9 is an enlarged front elevational view of the hood shown in FIG. 6.

Each of the hoods 20*a*–20*d* are generally rectangular boxes having a bottom 22, a top 24, front wall 26, rear wall 28, right side end wall 30 and left side end wall 32. The rectangular box so formed is typically made of chemically resistant material and, in one embodiment, 3/16" PVC material is employed which is suitably joined at the intersecting corners to form the enclosed container, such as by welding or by suitable bonding adhesives. The front wall 26 of each of the hoods includes a plurality of rectangular slots 25 positioned adjacent and slightly above tank 12, as best seen in FIGS. 1, 6 and 7, to draw fumes in the direction indicated by arrow B in FIG. 7 into the fume hoods for exhausting through duct 40*a*, as indicated by arrow C, and subsequently into a fume scrubber.

Figure 12:
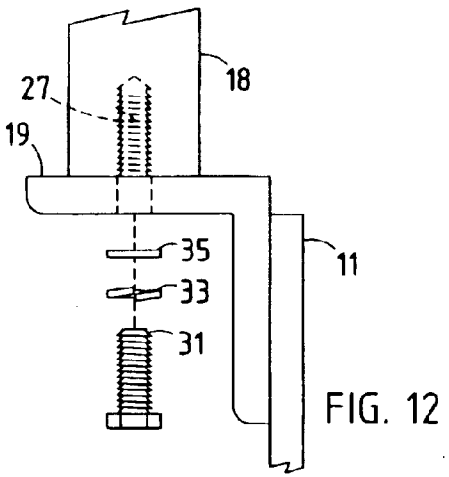
FIG. 12 is an enlarged fragmentary exploded view of one of the mounting structures employed for mounting the hoods shown in FIGS. 1–11.
Figure 13:
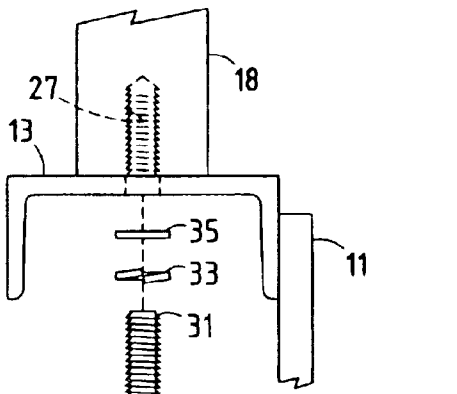
FIG. 13 is an enlarged fragmentary exploded view of an alternative mounting structure for the pivoted hoods.
Figure 10:
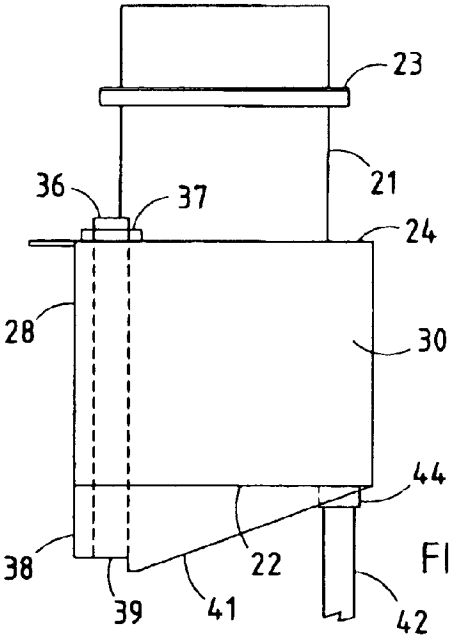
FIG. 10 right side elevational view of the hood shown in FIG. 9.

In order to pivotally mount each of the hoods to plating tank 12, a vertically extending stainless steel post 18 (FIGS. 12 and 13), having an outer diameter of 1.438 inches in one preferred embodiment, is secured either to a channel 13 (FIG. 13) at edge 11 of tank 12 or through a right angle bracket 19 welded to the front wall 11 of each of the tanks, as seen in FIG. 12. Upwardly extending post 18 is secured in a vertically oriented direction by threaded aperture 27 formed concentrically along the longitudinal axis of post 18 and by a threaded fastener, such as bolt 31 including a lock washer 33 and flat washer 35, as illustrated in FIGS. 12 and 13. Thus, a post 18 associated with each hood extends vertically upwardly a distance of approximately two feet (depending upon the size of a given hood) to extend, as best seen in FIGS. 6–10, through a mating sleeve 36 extending vertically through the hood.

The sleeve 36 serves as a bushing, allowing rotation of a hood around post 18 and extends through apertures in the top 24 and bottom 22 of each hood 20*a*–20*d*. The sleeve 36 is fixedly mounted by welding or bonding to the top 24 and bottom 22 of a hood, such as hood 20*a*. A reinforcing collar 37 (FIG. 11) is welded to the top 24 to provide additional support for the polymeric sleeve, which has an internal diameter of 1.476 inches to provide a sliding and rotatable fit between the external diameter of stainless steel post 18 and polymeric sleeve bushing 36. The reinforcing collar 37 provides rigidity at the upper end of the sleeve 36 to provide a stable pivot connection between each of the fume hoods 20*a*–20*d* and the associated vertically extending post 18. The bottom 22 of each hood may also include a similar reinforcing collar for sleeve 36.

Figure 7:
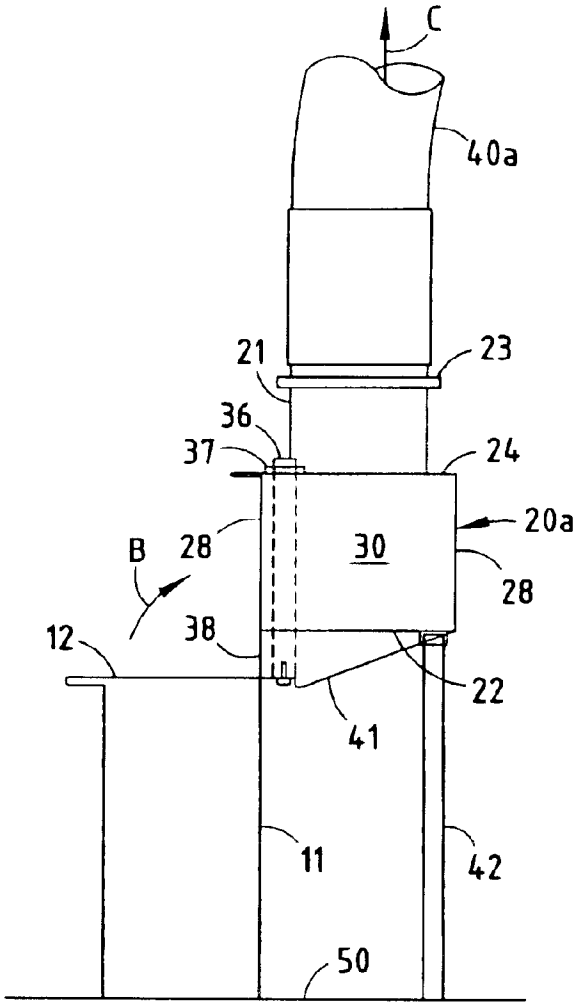
FIG. 7 is a side elevational view of the hood shown in FIG. 6.

Typically, the front edge of hoods 20*a*–20*d* will include a downwardly depending L-shaped skirt 38 having a horizontally and rearwardly extending section 39 (FIG. 10) which rests the channel 13 or angle iron 19 at the edge 11 of tank 12, as illustrated in FIG. 7. Further, reinforcing triangularly shaped gussets 41 are coupled to the bottom 22 and sides 30, 32 of fume hoods 20*a*–20*d* to provide a rigid structural support for the resting of the front edge of the hoods on the edge of tank 12 when in an operational position, as shown in FIGS. 1 and 7 in solid lines in FIG. 8.

Figure 8:
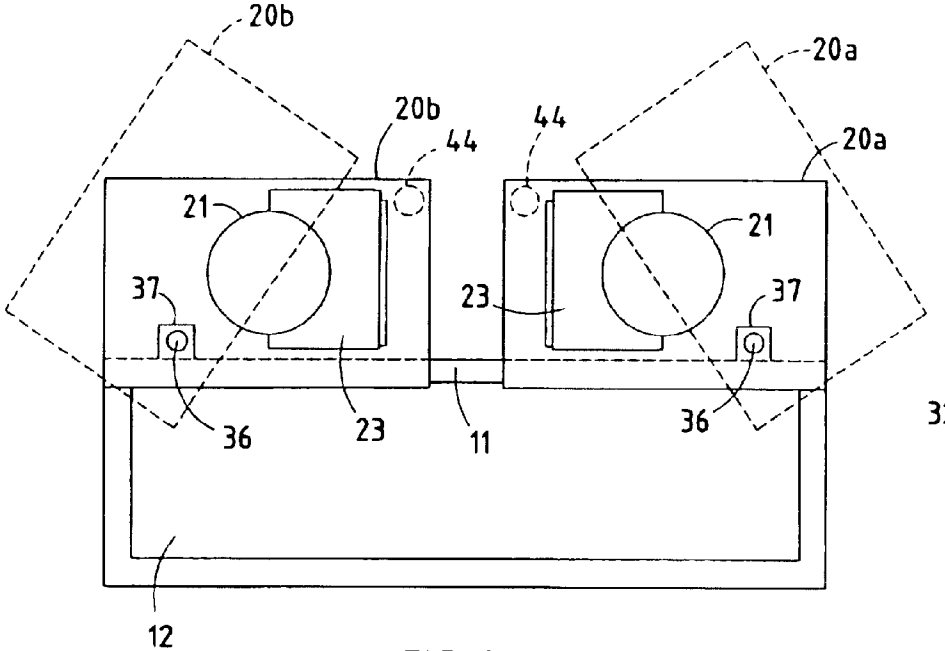
FIG. 8 is a top plan view of a pair of hoods embodying the present invention, shown in phantom in their open position.
Figure 11:
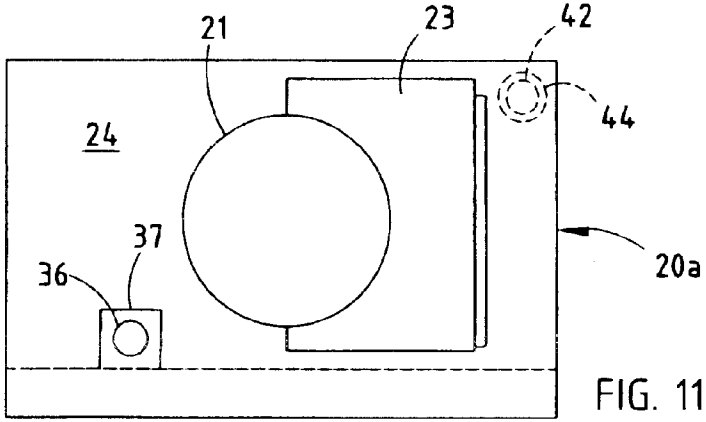
FIG. 11 is a top plan view of the hood shown in FIGS. 9 and 10.

Each of hoods 20*a*–20*d* further includes a downwardly depending support leg 42 which is positioned near a diagonally opposite corner from sleeve 36, as best seen in FIGS. 8 and 11, and which extends downwardly a distance corresponding to the distance between the bottom 22 of each of hoods 20*a*–20*d* and the floor surface 50 (FIGS. 6 and 7) upon which the plating tank 12 rests. Thus, when a fume hood is pivoted away from the edge 11 of tank 12, the fume hood is additionally supported by leg 42 in addition to the pivot connection between post 18 and sleeve bushing 36 to provide adequate support for the hoods when in the position shown in FIGS. 3–5. Leg 42 has sufficient strength and rigidity to provide a sliding support leg for the fume hoods when they are moved from the use position to an access position. In the preferred embodiment of the invention, leg 42 was made of a 2" diameter schedule 80 PVC material which was bonded by a collar 44 (FIGS. 9 and 10) to the bottom 22 of each hood to provided adequate strength.

Hoods 20*a*–20*d* include exhaust collars 21, which are integrally welded to openings in the top 24 of each fume hoods 20*a*–20*d* and include a sliding valve 23 to adjust the air flow as desired into the fume duct for controlling fumes from plating tank 12 and balancing the flow of exhaust fumes of the system with respect to other fume hoods along the plating line. In the system of the present invention, therefore, there is provided one or more pivoted fume hoods which are employed along the edge of a plating tank and which are pivotally coupled thereto for movement between operative positions aligned closely adjacent the tank to positions moved from the tank to allow access for replacement of zinc anodes, maintenance, or repair in the event a plating basket is dropped into the tank.

Although in the preferred embodiment a pivot connection is provided to allow this movement, other methods of translating, pivoting or otherwise movably coupling the fume hoods to the edge of a chemical tank may also be employed. As can be appreciated by those skilled in the art, the fume hoods of the present invention can be varied in numbers and dimension to accommodate different size facilities, different height and length of chemical tanks, and the like. Although described in the environment of a plating facility, the hoods and system of the present invention can be employed in an environment where it would be advantageous to have a movable fume hood. These and other modifications to the preferred embodiment of the invention as described herein can be made without departing from the spirit or scope of the invention as defined by the appended claims.

The invention claimed is:

1. A fume hood for exhausting fumes from a fixed work area comprising:

a generally box-shaped hood with at least one air inlet and an air outlet;

a coupling structure for movably coupling said hood to the fixed work area, such that said hood can be moved from an operative position with said air inlet adjacent the work area to an access position spaced from the work area for gaining access to the work area;

wherein said coupling structure comprises a pivot connection;

wherein the work area includes a chemical tank; and wherein said pivot connection comprises a sleeve extending generally vertically through said fume hood and a mounting post adapted to be secured to an edge of the chemical tank and extending in pivotal relationship within said sleeve for pivoting said hood with respect to a chemical tank.

2. The hood as defined in claim 1 wherein said hood includes a top, a bottom, side walls and front and rear walls integrally joined and wherein said bottom includes a support leg extending downward therefrom and having a length adapted to engage a support floor of the facility in which the hood is mounted.

3. The hood as defined in claim 2 wherein said support leg is positioned diagonally across from said sleeve.

4. The hood as defined in claim 3 wherein said hood is made of a chemical impervious polymeric material.

5. The hood as defined in claim 4 said material is polyvinyl chloride.

6. The hood as defined in claim 5 wherein said sleeve is a polyvinyl chloride tube.

7. The hood as defined in claim 6 wherein said post is a stainless steel post.

8. The hood as defined in claim 7 wherein the polyvinyl chloride tube has an inner diameter of about 1.47 inches.

9. The hood as defined in claim 8 wherein said post has an outer diameter of about 1.44 inches.

10. The hood as defined in claim 9 further including a reinforcing collar engaging said sleeve on the top of said hood.

11. A fume hood system for a plating tank comprising:

at least one pair of fume hoods, each having a generally box-shaped configuration with at least one air inlet positioned to be adjacent a plating tank;

a pivot coupling for pivotally coupling said fume hoods to an edge of the plating tank, such that said fume hoods can be pivoted from an operative position adjacent the plating tank away from the tank in opposed directions to provide a passageway for gaining access to the plating tank; and wherein said pivot coupling comprises a sleeve extending generally vertically through each of said fume hoods and mounting posts adapted to be secured to an edge of the plating tank in spaced relationship and extending in pivotal relationship within said sleeves for pivoting said fume hoods with respect to the plating tank.

12. The system as defined in claim 11 wherein said fume hoods each include a support leg extending downward therefrom and having a length adapted to engage a support floor of the facility in which the fume hoods are installed.

13. The system as defined in claim 12 wherein said support legs are positioned diagonally across from said sleeve bushings.

14. A fume hood for a plating tank comprising:

a polymeric fume hood having at least one air inlet and an air outlet collar;

a flexible outlet duct coupled to said air outlet collar;

a cylindrical sleeve extending generally vertically through said fume hood; and a mounting post adapted to be secured to an edge of the plating tank and extending in pivotal relationship within said sleeve for pivoting said fume hood with respect to a plating tank, such that said fume hood can be moved from an operative position adjacent the plating tank to a position spaced therefrom for gaining access to the plating tank.

15. The hood as defined in claim 14 wherein said fume hood includes a top, a bottom, said walls and front and rear walls integrally joined and wherein said bottom includes a support leg extending downward therefrom and having a length adapted to engage a support floor of the facility in which the fume hood is mounted.

16. The hood as defined in claim 15 wherein said support leg is positioned diagonally across from said sleeve.

17. The hood as defined in claim 16 wherein said fume hood is made of polyvinyl chloride.

18. The hood as defined in claim 17 wherein said sleeve is a polyvinyl chloride tube.

19. The hood as defined in claim 18 wherein said post is a stainless steel post.

20. The hood as defined in claim 19 wherein the polyvinyl chloride tube has an inner diameter of about 1.47 inches.

21. The hood as defined in claim 20 wherein said post has an outer diameter of about 1.44 inches.

22. The hood as defined in claim 21 and further including a reinforcing collar engaging said sleeve on the top of said hood.

* * * * *

UNITED STATES PATENT AND TRADEMARK OFFICE

CERTIFICATE OF CORRECTION

PATENT NO. : 6,846,236 B2
DATED : January 25, 2005
INVENTOR(S) : Larry M. Gregoricka It is certified that error appears in the above-identified patent and that said Letters Patent is hereby corrected as shown below:

Column 5,
Line 9, after "claim 4" insert -- wherein --;
Line 19, after "claim 9" insert -- and --.

Signed and Sealed this

Twenty-first Day of March, 2006

JON W. DUDAS
*Director of the United States Patent and Trademark Office*